US005433049A

United States Patent [19]

Karlsson et al.

[11] Patent Number: 5,433,049

[45] Date of Patent: Jul. 18, 1995

[54] PREFABRICATED BUILDING FOUNDATION ELEMENT

[76] Inventors: Göran Karlsson, Saturnusvägen 10, S-510 60 Överlida; Erik Thelberg, Hagvägen 4, S-437 42 Lindome, both of Sweden

[21] Appl. No.: 20,180

[22] Filed: Feb. 22, 1993

Related U.S. Application Data

[63] Continuation of Ser. No. 690,982, filed as PCT/SE89/00668, Nov. 20, 1989.

[30] Foreign Application Priority Data

Jan. 5, 1989 [SE] Sweden ..... 8900032
Aug. 17, 1989 [SE] Sweden ..... 8902760

[51] Int. Cl.[6] ..... E07D 27/00; E04C 2/00

[52] U.S. Cl. ..... 52/293.2; 52/294; 52/169.11; 52/309.17; 52/602

[58] Field of Search ..... 52/274, 404, 405, 406, 52/407, 169.11, 169.14, 602, 309.16, 309.17, 294, 319, 320, 321, 322, 293.1, 293.2

[56] References Cited

U.S. PATENT DOCUMENTS 2,114,048 4/1938 Davis ..... 52/602
2,184,464 12/1939 Myers ..... 52/293 X
2,786,004 3/1957 Schwartz et al. .
3,759,002 9/1973 Cornella et al. ..... 52/270
3,845,593 11/1974 Zen ..... 52/144
4,164,831 8/1979 Messick et al. ..... 52/405
4,223,502 9/1980 Robinson ..... 52/315
4,330,969 5/1982 Quaney ..... 52/81
4,602,467 7/1986 Schilger .

*Primary Examiner*—Carl D. Friedman
*Assistant Examiner*—Robert J. Canfield
*Attorney, Agent, or Firm*—Dvorak and Traub

[57] ABSTRACT

The prefabricated creep foundation in accordance with the invention is a building system for the laying of the foundations for a heated building with a beam structure above an enclosed, unventilated creep space. The foundations are constructed from base plates made of concrete, foundation beams made of concrete with internal cellular plastic, and ventilation grids for ventilation. The foundation beams consist of an externally reinforced high concrete slab with thick, cast-on-cellular plastic insulation on the inside. The creep space can be inspected more easily thanks to the considerable height of the foundation beams. The thick cellular plastic insulation on the foundation beams enables surplus heat to be utilized, so that the laying of the foundations can take place at a reduced foundation depth. The foundations can be laid using a crane, and can be adapted to the requirements of the project. The invention also relates to a method and means for the production of elements from which the foundations can be constructed.

7 Claims, 8 Drawing Sheets

Fig.12
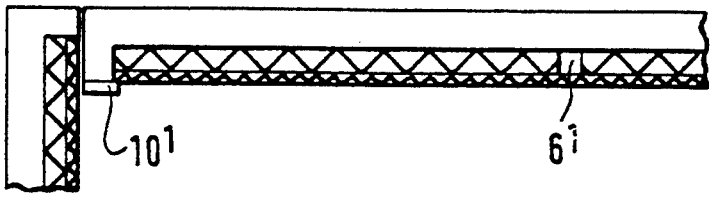
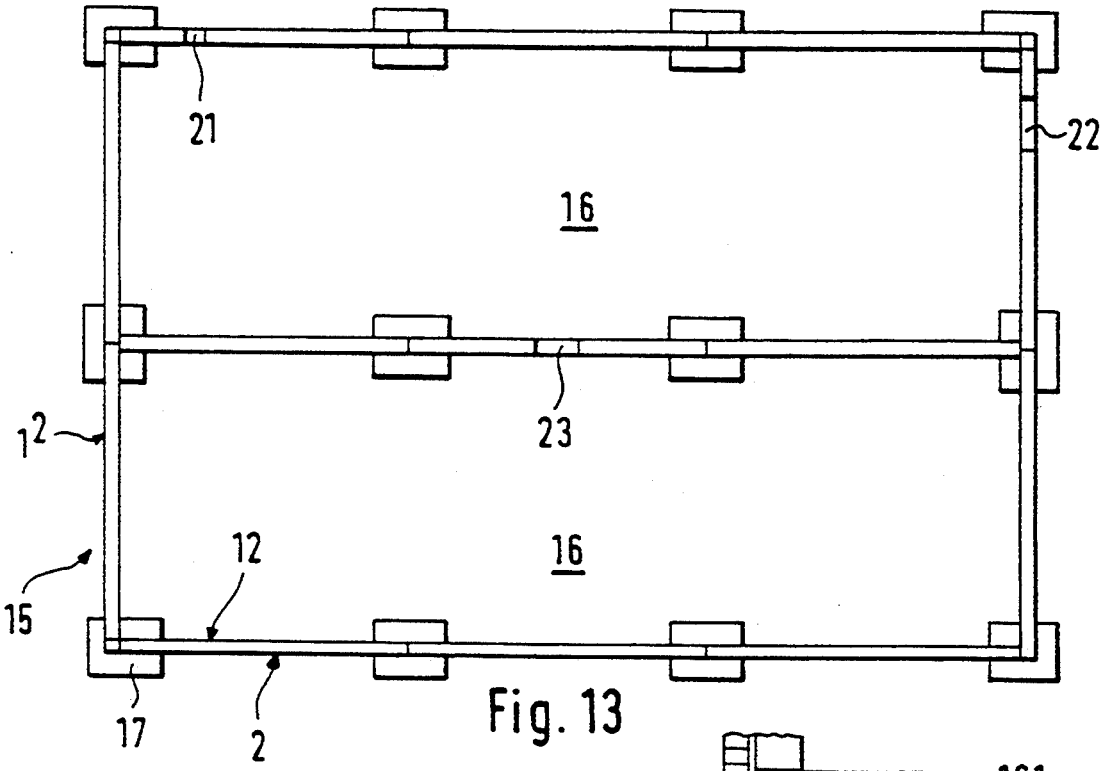
Fig. 13
Fig.14
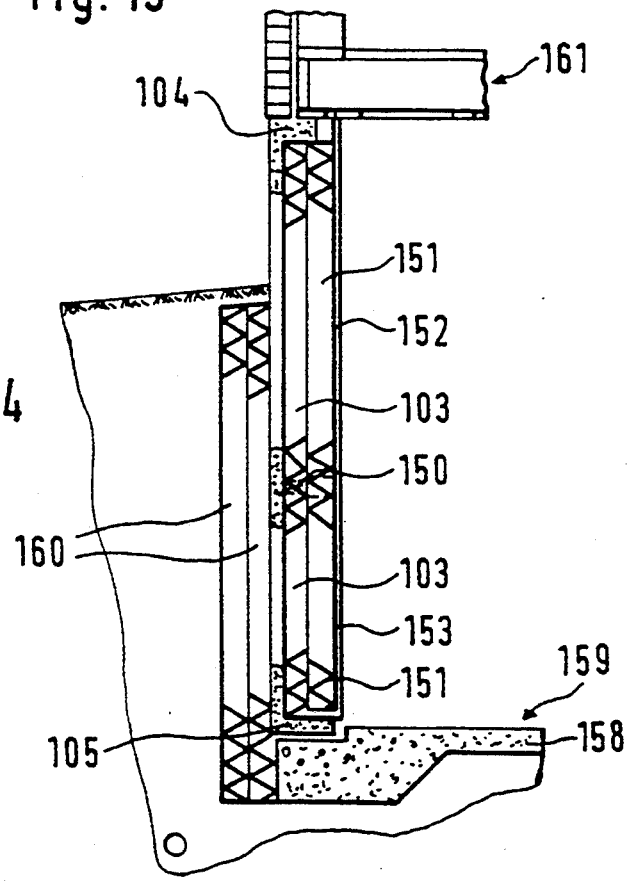

PREFABRICATED BUILDING FOUNDATION ELEMENT

This application is a continuation of application Ser. No. 07/690,982, filed as PCT/SE89/00668, Nov. 20, 1989.

The present invention relates to a prefabricated building foundation element made of concrete, light clinker or light concrete, etc., being first and foremost a foundation construction or a foundation beam for so-called creep foundation structures or building foundations, incorporating thermal insulation supported by the element.

A customary method used within the building industry for the manufacture of foundation beams from concrete, light clinker or light concrete, etc., involves casting beams of rectangular cross-sectional form. The foundation beams, which inscribe the creep area, and the outside of which is at ground level, are provided on the inside with thermal insulation permanently attached with adhesive. As an alternative, insulation can be cast into the centre of the beam. The disadvantage associated with previously disclosed methods is that the consumption of materials, such as concrete, is high, as a result of which the foundation construction is more expensive. There is also a disadvantage associated with the subsequent installation of thermal insulation on the inside. A further disadvantage of solid rectangular beams is the need to meet the requirement for a higher beam height, in order in that way to avoid frost action (heave) and the penetration of backfilling material beneath the beam. A high solid beam is excessively demanding of materials and is more expensive.

Also disclosed in SE-B 442,654 is the execution of a foundation beam of C-shaped cross-section. The aforementioned construction assumes that any vertical load will be transferred down through the body of the beam. An eccentric load on the legs gives rise to an axial torsional moment vector, which on the one hand causes instability and on the other had causes overstressing of the thin, slab-shaped body.

The principal object of the present invention is, in the first place, simply and effectively to solve said problems and to produce prefabricated building foundation elements at a lower price, partly due to a reduced consumption of materials and a simple manufacturing operation, and to obtain elements which function effectively, so that inter alia an eccentric load on the flanges in question of the element can be supported with further improved strength characteristics as a result.

Said object is achieved by means of elements in accordance with the present invention, which is characterized essentially in that bracing extending between the upper and the lower beam flange is so arranged as to transfer the load down from the upper beam flange to the lower beam flange.

The invention also relates to a method for the manufacture of elements in accordance with the foregoing in a simple fashion and with a small consumption of materials, which method is characterized essentially in that said elements are manufactured by casting in between slabs of cellular plastic insulation accommodated in a mould at a certain distance from one another, so that concrete, etc., is able to penetrate between the butt joints of the slabs and to form bracings on setting, or into a casting mould, one side of which mould has a pattern of fixed ribs to form cast bracings between them.

The invention also relates to means for the manufacture of such elements in a simple and efficient manner.

The means for said purpose are characterized essentially in that a casting mould permits the accommodation of slab-shaped bodies capable of being laid separately in the mould, for example thermal insulation slabs of cellular plastic or ribs of an appropriate kind, or in that the mould includes fixed ribs, for example made of sheet metal or plywood.

The invention is described below with reference to a number of preferred illustrative embodiments, in conjunction with which reference is made to the drawings, where:

FIGS. 1–13 show one example of a foundation beam for a creep foundation, of which FIG. 1 shows a section through an element in accordance with the invention functioning as a foundation beam;

FIG. 2 shows a plan section of an element;

Figure 2:
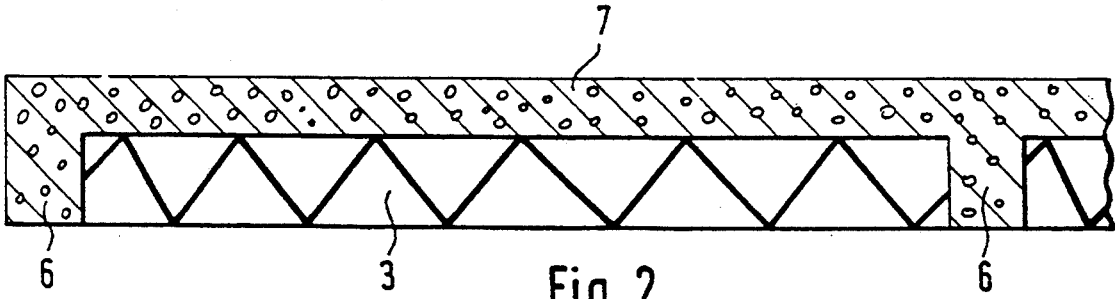
Figure 2A:
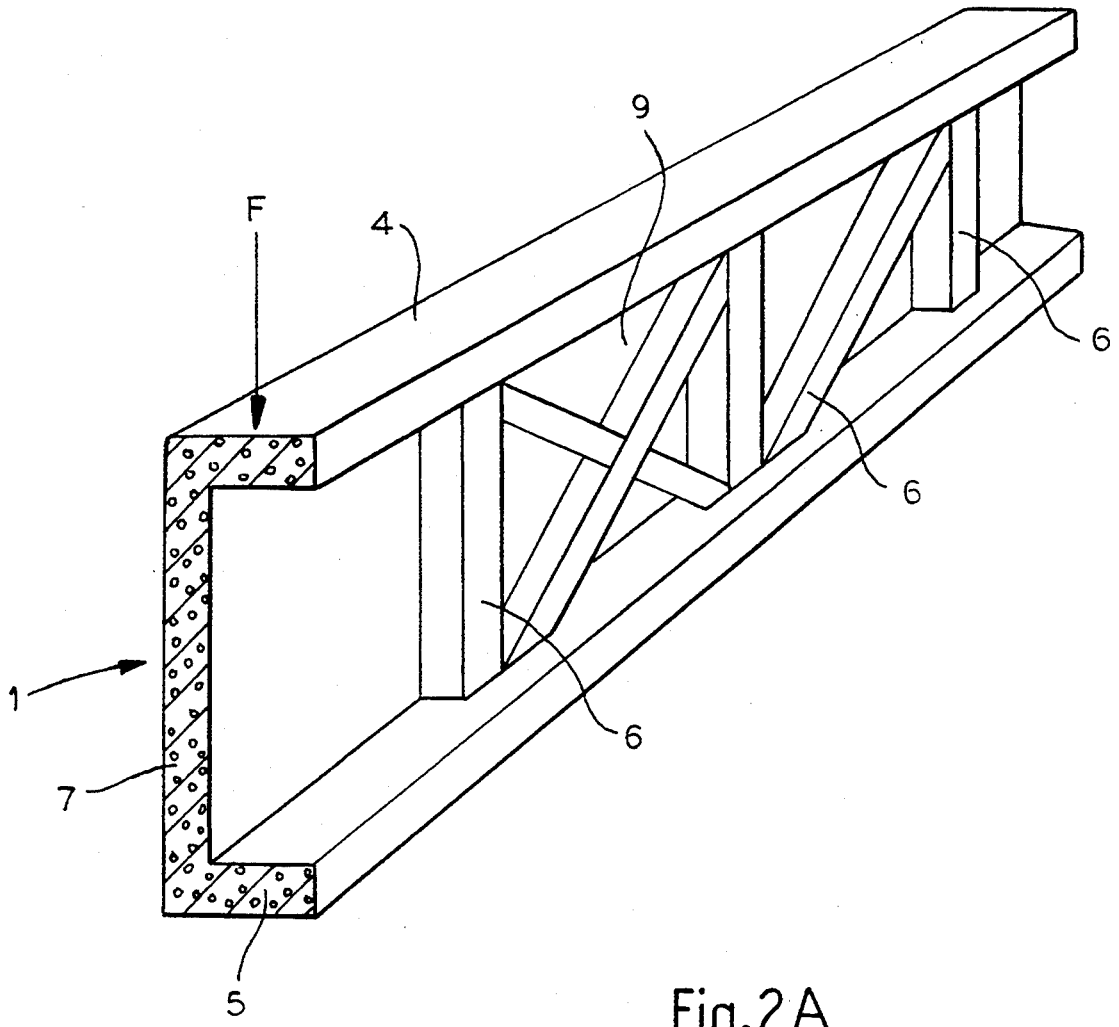

FIG. 2*a* is a perspective view of a foundation element having a recessed load support brace having slabs of cellular plastic material disposed on and in contact with the load support brace.

Figure 4A:
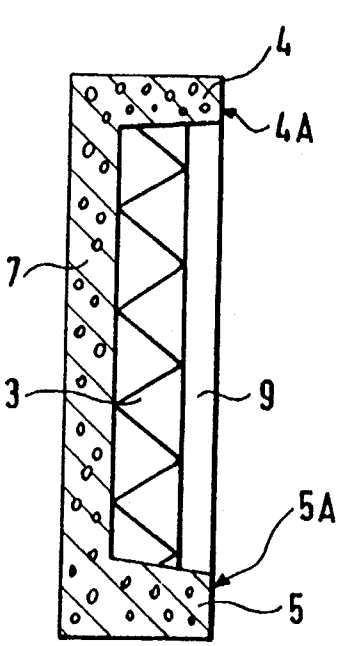
Figure 4:
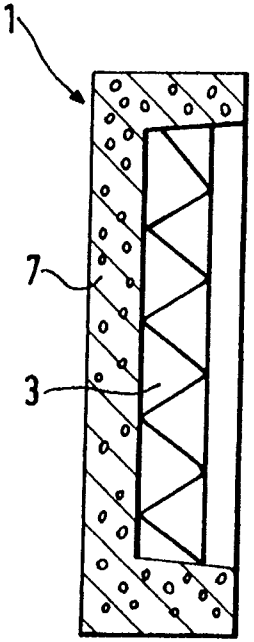
Figure 3:
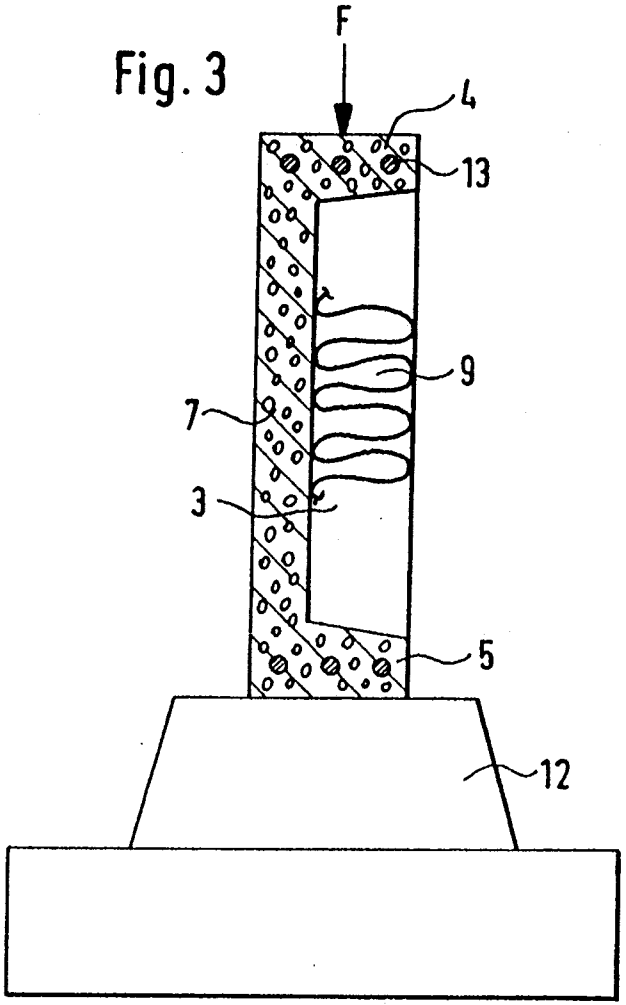
Figure 5:
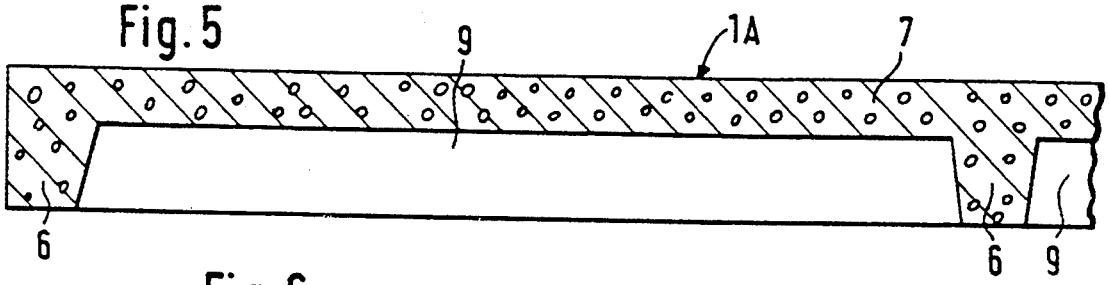
Figure 6:
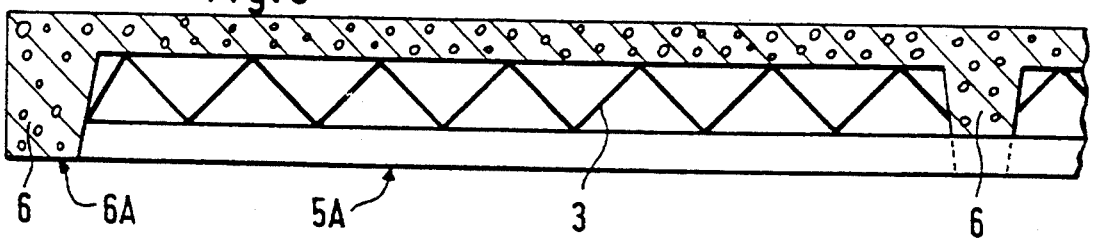
Figure 7:
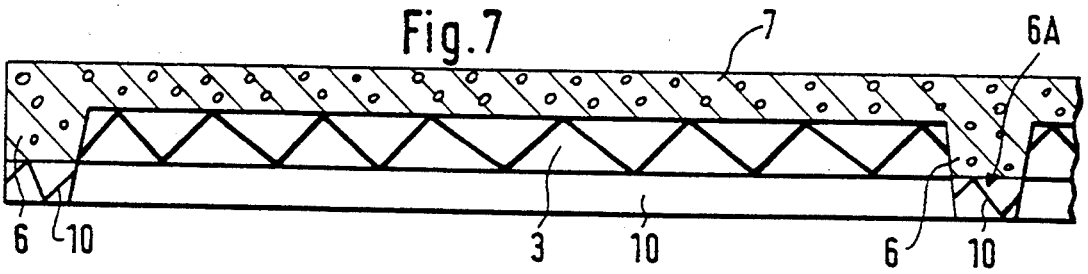
Figure 8:
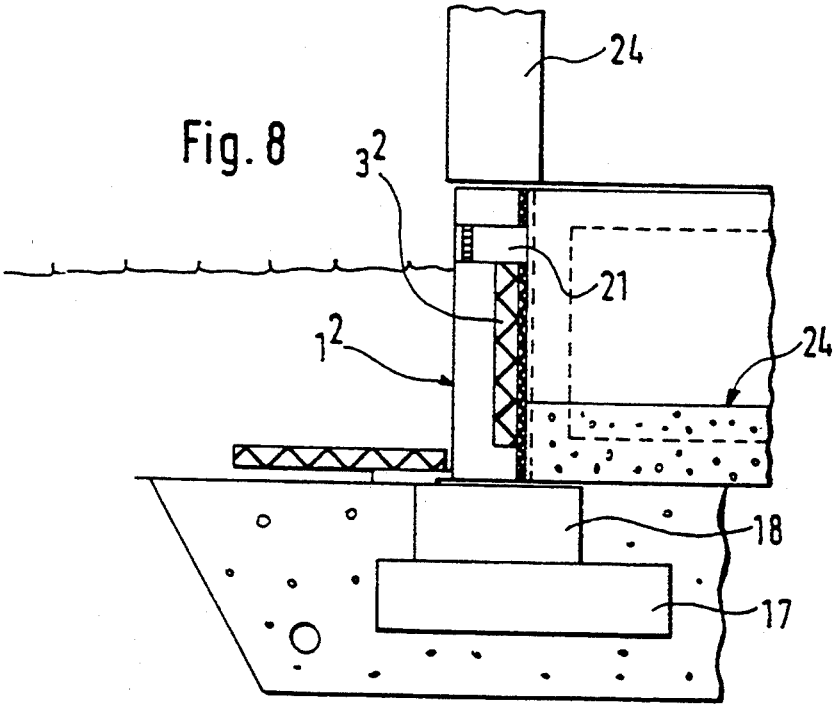
Figure 9:
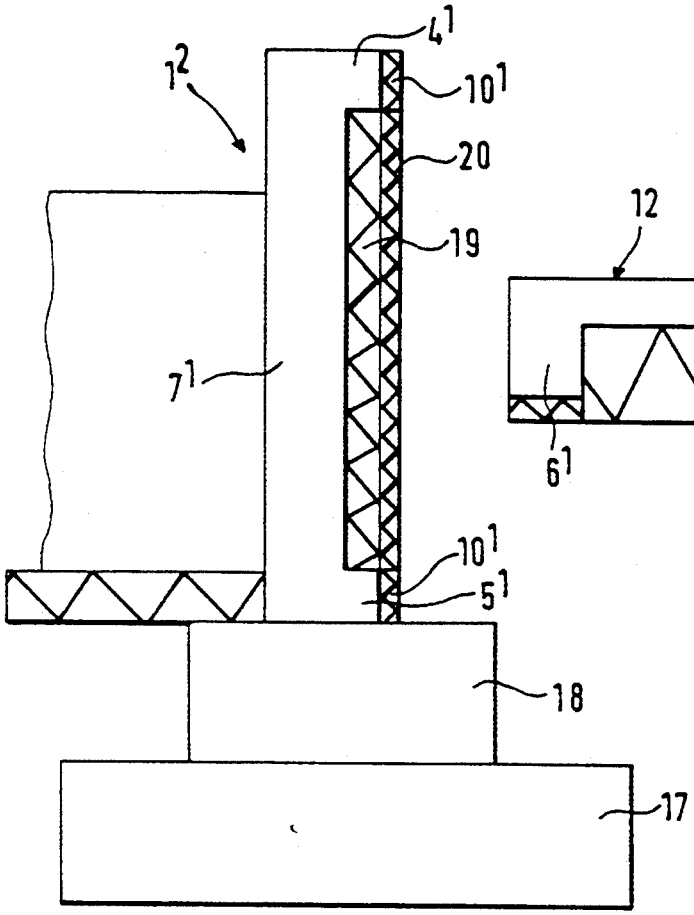
Figure 10:
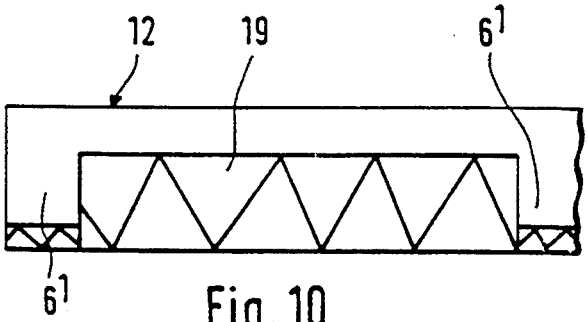
Figure 11:
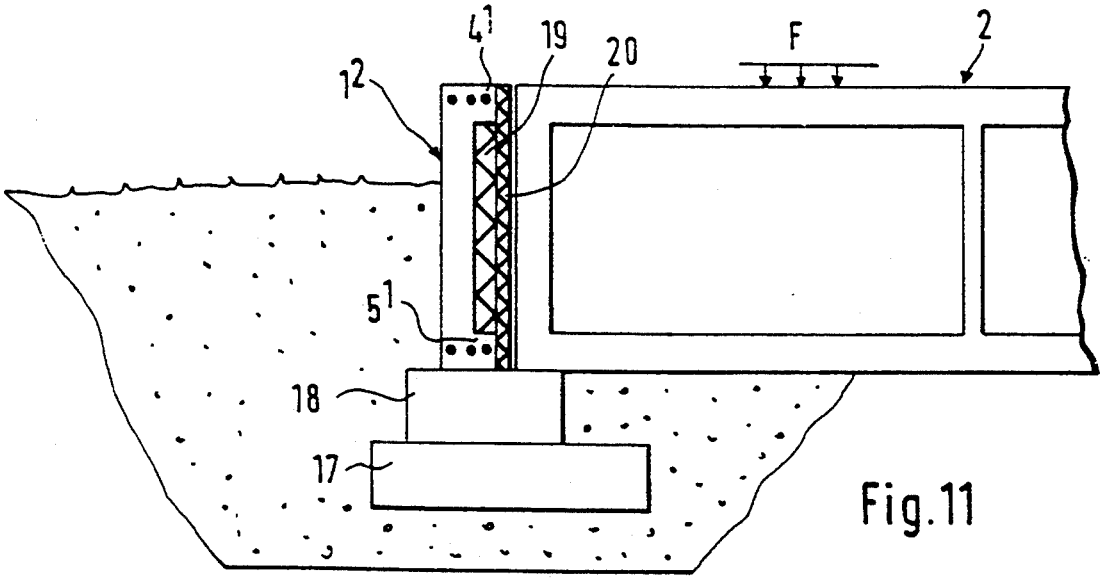
Figure 15:
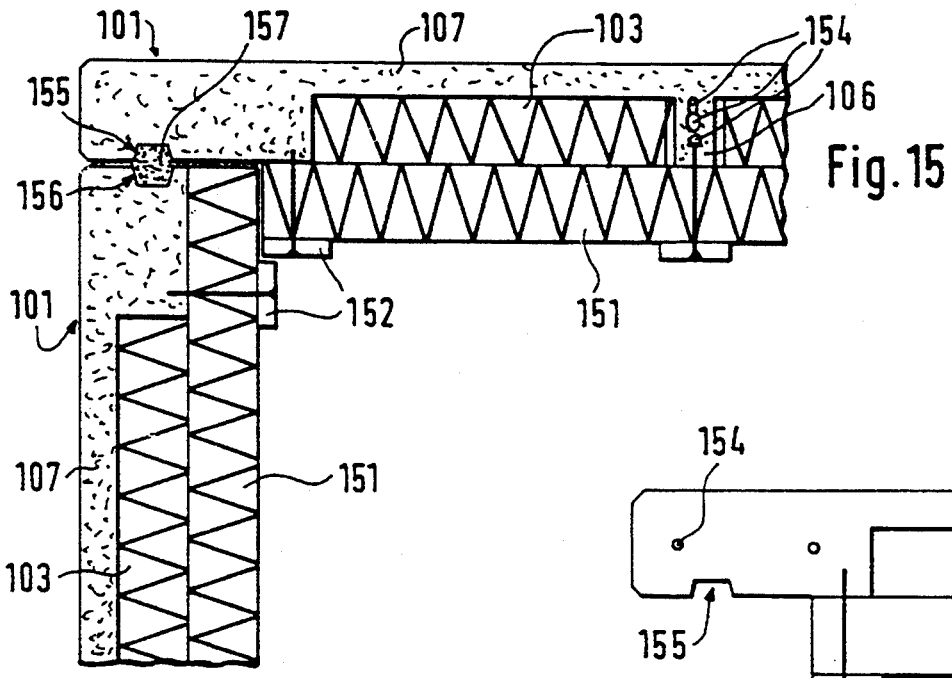
Figure 16:
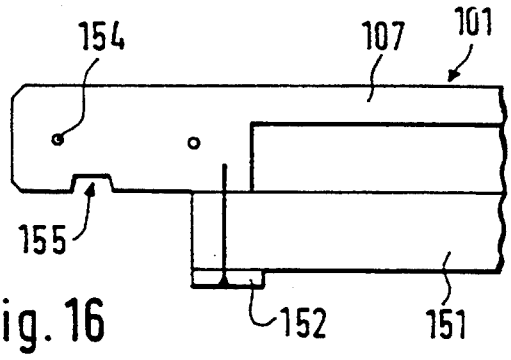
Figure 17:
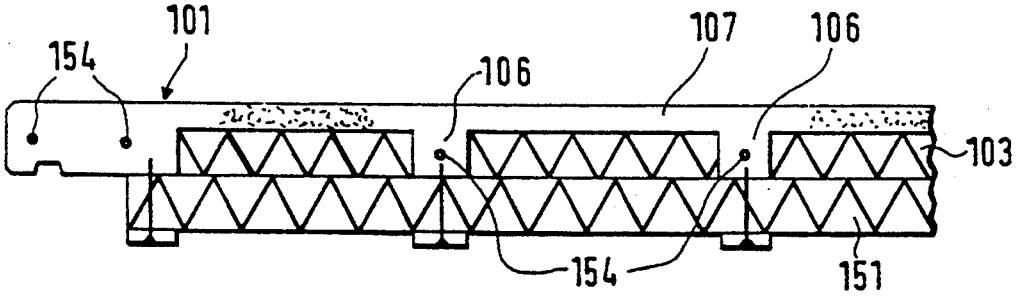
Figure 18:
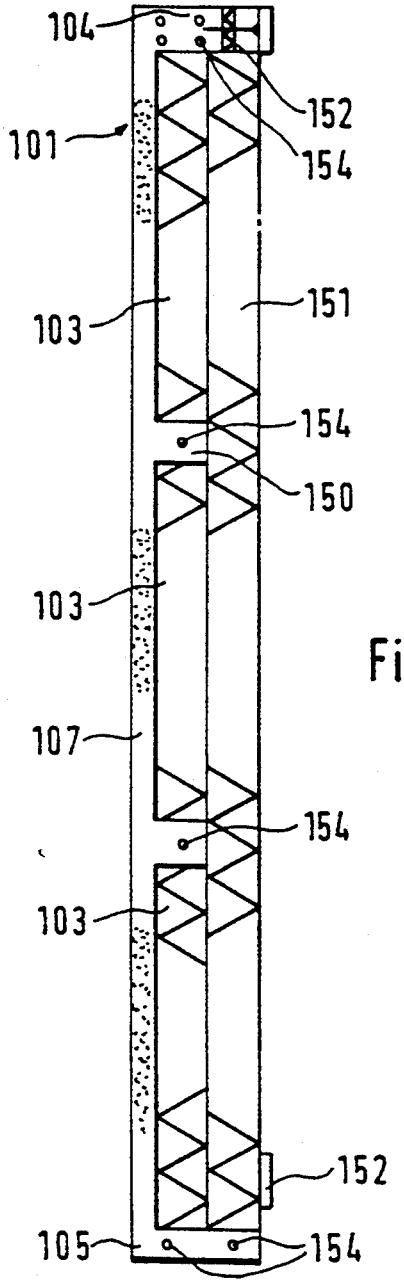
Figure 19:
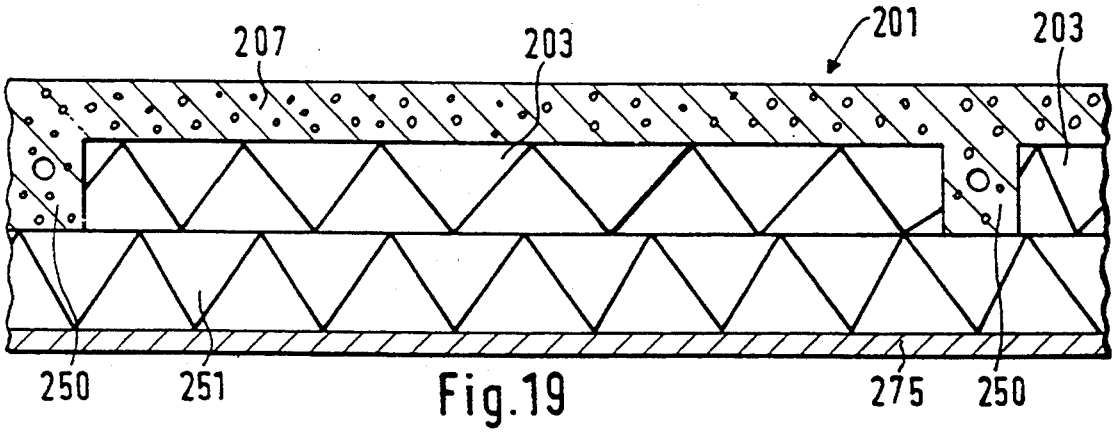

FIG. 3 also shows a section through an element installed as a foundation beam;

FIGS. 4–4A show a section through an element;

FIGS. 5–7 show plan sections of an element of different designs;

FIG. 8 shows the element in its intended function as a creep foundation structure;

FIG. 9 shows a section through an element, showing the insulation;

FIG. 10 shows a plan section of said element;

FIG. 11 shows a section through the connection of the elements at a corner;

FIG. 12 shows a plan section of the elements at a corner;

FIG. 13 shows a view from above of a foundation produced using elements in accordance with the present invention;

FIGS. 14–16 show an example of an element intended for a foundation, of which FIG. 14 shows a section through a foundation with a cast base plate;

FIG. 15 shows the construction of the element and the connection of same at a corner in a foundation viewed from above;

FIG. 16 shows one end of an element, similarly viewed from above;

FIG. 17 shows a section along a cellar wall element;

FIG. 18 shows a section across a cellar wall element;

FIG. 19 shows an example of a building element which exhibits cladding.

A prefabricated building foundation element 1 made of concrete, light clinker, light concrete or some other appropriate building material, which is suitable for use in the manufacture of an element intended first and foremost as a foundation construction or foundation beam for a so-called creep foundation structure 2, and which in a previously disclosed fashion incorporates thermal insulation 3 supported by the element 1 in question, exhibits a number of bracings 6 extending between the upper beam flange 4 and the lower beam flange 5. Said bracing/s 6, which can extend vertically and/or diagonally between the preferably horizontally arranged beam flanges 4, 5, is/are so dimensioned as to be capable of transferring the load F down from the upper beam flange 4 to the lower beam flange 5. The element 2 is essentially in the form of a beam with a preferably similar U-shaped cross-sectional profile, with the flanges 4, 5 extending in a common direction from a preferably narrow, slab-shaped, upright body 7.

The invention, which is intended essentially for use within the building industry, enables high, light foundation beams, especially for so-called creep foundation structures, to be produced simply and economically. The vertical bracings 6, for example, strengthen the beam in such a way that an eccentric load acting on the flanges 4, 5, for example from a beam structure, can be withstood. Considerable increases in torsional strength and shearing strength are also achieved, thanks to the function of the vertical bracing 6, for example, as yokes. The body thickness of the beam can also be reduced to, for example, only 20–30 mm and can also be executed without reinforcement, thanks to the favourable interaction with the, for example, vertical bracings 6.

Thanks to the bracings 6, it is possible to manufacture beams of low weight with low material consumption. The bracings 6 can be produced by causing lightweight thermally insulating slabs 8, for example of cellular plastic material, to be laid in a casting mould. By leaving a space between the butt joints of the slabs, concrete is able to penetrate in between to form the bracings 6.

The bracings 6 can also be produced by causing one side of the mould to have fixed ribs, for example made of sheet metal or plywood. After removal of the mould, the resulting beam is a lightweight beam, which is economical of materials, with bracings on the inside and with a smooth external surface=footing or plinth. Insulation 3 consisting of, for example, cellular plastic slabs, will then be supported internally 9 in and/or on the inside of the element.

Insulation 3, 10 can, as an alternative to being held secure on the insulating slab 1 internally within same, also be secured to the inside 6A and 4A, 5A of the bracings 6 and/or the beam flanges 4, 5.

According to one preferred illustrative embodiment, the foundation beam element 1 consists of an externally stiffened concrete slab 7 with cast-on, inward-facing cellular plastic insulation 3 in a cavity 9 formed between the flanges 4, 5 of said slab and bracings 6, and can preferably also support insulation 10, attached for example by adhesive bonding, on the inward-facing surface 4A, 5A and 6A of said surrounding beam flanges 4, 5 and bracings 6. The latter insulation 10 on the flanges 4, 5 and the bracings 6 is intended first and foremost to prevent cold bridges. It should accordingly be noted that the Surrounding beam flanges 4, 5 can extend further inwards from the outer surface 1A of the element than the distance for which the interjacent bracings extend.

The invention may, for instance, be applied in accordance with the following example:

Foundation beams 1 in accordance with the invention are laid on base plates 11, which may exhibit a superstructure 12. The foundation beam 1 may exhibit rectangular cross-sectional form, although the supporting material 7, 4, 5 should preferably exhibit U-shaped cross-section lying on its side. The supporting material, which, for example, consists of concrete or light clinker, etc., may also contain necessary reinforcement 13, 14. Ribs or other bracings 6 of suitable form and extent are so arranged as to extend between the upper flange 4 and the lower flange 5 of the element 1, in order to achieve high torsional stiffness and a high capacity to absorb transverse forces. The ribs, etc., 6 can be so arranged as to extend vertically and to be connected together laterally by means of a number of diagonally extending additional ribs or other bracing, in the form of a lattice.

Figure 1:
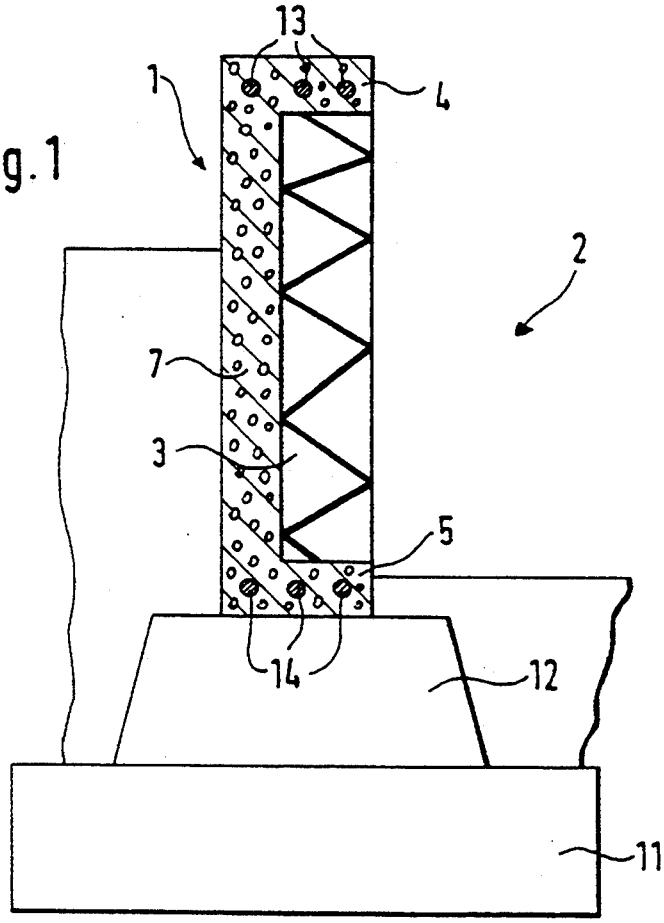

The beam 1 can thus contain, as already mentioned, thermally insulating material 3 or a rib made of an inexpensive material, as illustrated in FIGS. 1–2, for example.

FIGS. 3–7 illustrate examples of an element $\mathbf{1}^1$, in which a rib made of an inexpensive material or insulation 3 is not integrated with the element 1, but in which the beam 1 was cast in a mould which imparts the desired cross-sectional form to the beam, although additional insulation 10 is adhesive-bonded, etc., internally to the insides 4A, 5A, 6A of the flanges 4, 5 and the bracings 6.

FIGS. 8–13 illustrate further examples of the application of the invention in connection with the construction of the foundations 15 for a building.

The prefabricated creep foundation contains parts of a building system for the laying of the foundations for a heated building with a beam structure above an enclosed, unventilated creep space 16. The creep foundations 15 are constructed from base plates 17 and, possibly, height extension plates 18 made of concrete, foundation beams 12 made of concrete with internal cellular plastic 19, 20 in a number of layers, and ventilation grids 21 for ventilation. The foundation beams 13 consist of an externally reinforced high concrete slab $\mathbf{7}^1$ with thick, cast-on cellular plastic insulation 19, 20 on the inside. The creep space 16 can be inspected more easily thanks to the considerable height of the foundation beams. The thick cellular plastic insulation on the foundation beams 13 enables surplus heat to be utilized, so that the laying of the foundations can take place at a reduced foundation depth. The foundations should preferably be laid using a crane, and the length of the foundation beams can be adapted to the requirements of the project.

The creep foundations 15 can be used for buildings with both light and heavy facing, for example of brick, and they are dimensioned in accordance with Svensk Byggnorm SBN 80 (Swedish Building Standards). The inside of the beams $\mathbf{1}^3$ can also support thermal insulation $\mathbf{10}^1$, which has been attached, for example by adhesive bonding, to the inward-facing surfaces of the flanges $\mathbf{4}^1$, $\mathbf{5}^1$ and the bracing $\mathbf{6}^1$.

A layer of macadam of at least 200 mm in thickness should be laid as the base for the base plates.

External drainage pipes and drainage are normally required. If the surface of the ground inside the creep space 16 is not self-draining, the ground should be drained in such a way that standing water is removed.

The invention can, of course, also be applied without the use of any special foundation structure of plinths in the form of, for example, the previously described base plates, possibly with a superstructure, but is equally well suited to erection directly on the ground or on insulation resting on the ground, along which the formation beams in question can be laid for the whole of its longitudinal extent resting directly on the ground or the insulation.

Ventilation of the creep space is provided by means of, for example, vent holes 21 fitted with grids. An external inspection opening 22 can be positioned at any suitable location depending on the prevailing ground conditions, and internal inspection holes 23 can also be present. The surface of the ground inside the creep space 16 is covered with, for example, 0.20 mm thick, type-approved plastic sheeting 24, with a minimum overlap of 200 mm.

A building 24 of the desired kind can thus be erected on the foundation, when the foundation will effectively permit the load to be transferred down to the ground in accordance with the foregoing.

The embodiment of the invention illustrated in FIGS. 14–16 similarly comprises prefabricated building foundation elements 101 produced from a suitable material such as concrete, light clinker or light concrete, etc., with thermal insulation 103 which is supported by the element 101 in question. Said elements 101 exhibit a number of bracings 106 extending between the upper and lower beam flanges 104 and 105, which bracings are formed from the material of the element. Said bracings 106 may also extend vertically and/or diagonally between the preferably horizontally arranged beam flanges 104, 105, and may even be supplemented with interjacent horizontal partitions 150, which divide up the insulation space into upper and lower compartments to accommodate insulation slabs 103 in the course of producing the elements. Extra insulation 151 can be attached to the inside of the elements 101, for example by securing it with nails, together with battens 152 for the attachment of inner wall cladding 152, for example sheets of plaster of fibre material, when elements 101 are to form building cellar elements, as shown in FIG. 14, for example.

Said elements 101 may also contain reinforcement 154, and at the ends of the bodies 107 of the elements, which bodies should preferably have been produced with their full standing height, there may be arranged a groove 155, 156, which can be used for connection purposes when the elements 101 have been erected and are in a position ready for being connected together, for example by pouring mortar into the tubular cavity 157 thus formed between the elements 101, holding them in position.

A concrete plate 158 is cast at the bottom of, and inside the foundation thus formed, to support an inner floor 159, whilst extra external installation, in the form of cellular plastic slabs 160, is applied to the outside of the elements extending vertically along them.

The building 161 itself can rest upon the upper flanges 104 of said elements, when the load is effectively transferred down to the ground via the elements 101 and their associated bodies 107 and bracings 106, without the risk of creating an oblique load.

FIG. 19 illustrates an example of a building element 201, in which an inner cladding, for example a sheet of plaster or similar, is integrated with the insulation 251, 203 of the element. Said inner cladding 275 may, for example, be adhesive-bonded or secured in some other appropriate fashion to adjacent insulation 251. Said element 201 may be arranged and manufactured in accordance with what is referred to and illustrated above for the other exemplified building elements. It may be found appropriate to cause the inner cladding 275 to be integrated with the common layers 203, 251 of insulation composed preferably in the sense of the depth of the element in conjunction with the casting of the building element 201, which can be made from a concrete material, where concrete partitions 250 are formed in the concrete slab 207 between the positioned slabs 203 of insulating material.

The invention is not, however, restricted to the illustrative embodiment described above or illustrated in the drawings, and may be modified within the scope of the patent claims without departing from the idea of invention.

We claim:

1. A prefabricated building foundation element made of concrete, light clinker or light concrete, first and foremost for so-called creep foundation structures or building foundations, the element comprising:

an upper and a lower horizontal beam flange arranged in the same direction from an upright slab-shaped body;

a bracing extending between the upper and the lower beam flanges arranged to transfer a load down from the upper beam flange to the lower beam flange, which bracing is formed from the material of the element, wherein the bracing is recessed in relation to the beam flanges; and a thermal insulation supported by the element, wherein the thermal insulation is cast-on and supported internally against an inward-facing inside of the element between the beam flanges and the bracing, with thermal insulation attached to inward-facing surfaces of the surrounding beam flanges and the bracing to prevent formation of thermal bridges.

2. The element of claim 1, further comprising a bracing extending diagonally between the horizontal beam flanges.

3. The element of claim 1, wherein the insulation includes slabs of a cellular plastic material.

4. A prefabricated structural foundation element comprising:

an upright slab-shaped body formed of light clinker, and having an upper end, a lower end, an inner surface and an outer surface;

a upper beam flange formed of light clinker, and disposed on the upper end of the slab-shaped body;

a lower beam flange formed of light clinker, and disposed on the lower end of the slab-shaped body, the lower beam flange being substantially parallel to the upper beam flange;

a load support brace, formed of light clinker, on the inner surface of the slab-shaped body and extending between the upper beam flange and the lower beam flange to transfer a load from the upper beam flange to the lower beam flange, the load support brace being recessed relative to the upper beam flange and the lower beam flange wherein the upper beam flange, the lower beam flange and the load support brace are integrally formed with the slab-shaped body; and insulation disposed between and in contact with both the upper beam flange and the lower beam flange, the insulation disposed on and in contact with the inner surface of the slab-shaped body, and the insulation disposed on and in contact with all surfaces of the load support brace, wherein the contact between the insulation and the upper beam flange, the lower beam flange, the inner surface of the slab-shaped body, and the load support brace prevent formation of thermal bridges.

5. A prefabricated structural foundation element comprising:

an upright slab-shaped concrete body having an upper end, a lower end, an inner surface and an outer surface;

a concrete upper beam flange disposed on the upper end of the slab-shaped body;

a concrete lower beam flange disposed on the lower end of the slab-shaped body, the lower beam flange being substantially parallel to the upper beam flange;

a concrete load support brace on the inner surface of the slab-shaped body and extending between the upper beam flange and the lower beam flange to transfer a load from the upper beam flange to the lower beam flange, the load support brace being recessed relative to the upper beam flange and the lower beam flange wherein the upper beam flange, the lower beam flange and the load support brace are integrally formed with the slab-shaped body; and insulation disposed between and in contact with both the upper beam flange and the lower beam flange, the insulation disposed on and in contact with the inner surface of the slab-shaped body, and the insulation disposed on and in contact with all surfaces of the load support brace, wherein the contact between the insulation and the upper beam flange, the lower beam flange, the inner surface of the slab-shaped body, and the load support brace prevent the formation of thermal bridges.

6. The element of claim 5, wherein the insulation is adhesive hardened to the upper beam flange, lower beam flange and load support brace.

7. The element of claim 5, wherein the insulation comprises slabs of cellular plastic material.

* * * * *